US009516416B2

(12) United States Patent
Yang et al.

(10) Patent No.: US 9,516,416 B2
(45) Date of Patent: Dec. 6, 2016

(54) MULTI-LOUDSPEAKER ACTIVE NOISE CANCELLING HEADPHONE PROVIDING STEREO EFFCT AND IMPROVED AMBIENT NOISE REDUCTION

(71) Applicant: Lab9 Inc., Hsinchu (TW)

(72) Inventors: Yin-Jiun Yang, Hsinchu (TW); Ching-Jen Lee, Hsinchu (TW)

(73) Assignee: LAB9 INC., Hsinchu (TW)

( * ) Notice: Subject to any disclaimer, the term of this patent is extended or adjusted under 35 U.S.C. 154(b) by 80 days.

(21) Appl. No.: 14/697,074

(22) Filed: Apr. 27, 2015

(65) Prior Publication Data

US 2016/0316297 A1 Oct. 27, 2016

(51) Int. Cl.

| | |
|---|---|
| ***H04R 5/02*** | (2006.01) |
| ***H04R 5/033*** | (2006.01) |
| *H04S 1/00* | (2006.01) |
| *H04R 1/10* | (2006.01) |
| *G10K 11/178* | (2006.01) |

(52) U.S. Cl.

CPC ..... *H04R 5/033* (2013.01); *G10K 11/1782* (2013.01); *H04R 5/02* (2013.01); *G10K 11/178* (2013.01); *H04R 1/10* (2013.01); *H04R 2460/01* (2013.01); *H04S 1/005* (2013.01)

(58) Field of Classification Search

CPC ..... H04R 1/1083; H04R 5/033; H04R 1/10; H04R 5/02; G10K 11/16; G10K 11/178; G10K 11/1782; H04S 1/005; H04S 7/304

USPC ..... 381/71.1, 71.2, 71.4, 309, 17, 1, 13, 381/300, 310, 71.6, 71.11

See application file for complete search history.

(56) References Cited

U.S. PATENT DOCUMENTS 8,077,874 B2 12/2011 Sapiejewski

FOREIGN PATENT DOCUMENTS

TW M359891 U 6/2009

*Primary Examiner* — Vivian Chin
*Assistant Examiner* — Ubachukwu Odunukwe
(74) *Attorney, Agent, or Firm* — Muncy, Geissler, Olds & Lowe, P.C.

(57) ABSTRACT

A multi-loudspeaker active noise cancelling headphone that can provide stereo effect and improve the performance of ambient noise reduction employs an active noise reduction circuit to collaborate with a plurality of speakers and a design to generate a multilayer phase difference feedback audio signal in the earmuffs of the headphone to improve the performance of noise reduction efficacy and generate stereo effect for music so that through the speakers of a lower cost and in a medium quality, and individual filters and signal compensation music with spatial sense and a sense of depth can be generated.

5 Claims, 3 Drawing Sheets

MULTI-LOUDSPEAKER ACTIVE NOISE CANCELLING HEADPHONE PROVIDING STEREO EFFCT AND IMPROVED AMBIENT NOISE REDUCTION

FIELD OF THE INVENTION

The present invention relates to an active noise cancelling headphone and particularly to a multi-loudspeaker active noise cancelling headphone that can provide stereo effect and improve ambient noise reduction.

BACKGROUND OF THE INVENTION

These days electronic products have become increasingly personalized and multifunctional. Activities such as listening music, watching movies and chatting via videos through electronic products are increasingly popular among many people. In order to get full and improved sound quality and avoid affecting other people most people would do the aforesaid activities by using headphones. However, the sound quality in the headphones could suffer due to too much ambient noise. To resolve this problem noise reduction headphones that can reduce ambient noise have been developed and increasingly accepted by consumers. At present the noise reduction techniques adopted in the electronic products mainly can be divided into active noise reduction and passive noise reduction.

The headphone of the conventional passive noise reduction technique aims to reduce external background noise. For instance, Taiwan patent No. M359891 entitled "Noise-proof headphone" discloses a noise-proof headphone which includes a hanging arm and a shell. The shell is located at two ends of the hanging arm and includes a shell cap and a shell body that form a housing space between them to hold a circuit board and a loudspeaker. The circuit board is formed in a shape mating the shell cap to couple tightly therewith so that the housing space is divided into a plurality of air chambers to isolate external noise.

Since the aforesaid noise-proof headphone has the circuit board and the shell cap tightly coupled together, a sound isolation wall is formed to isolate low frequency audio signals so that low frequency sound passing through the shell can be blocked by the sound isolation wall and the air chambers to reduce the external low frequency noise. However, in the event that the background sound is excessively large the sound in the headphone can still be affected, hence the aforesaid method of isolating the external background sound by blocking is limited in effectiveness.

Because of the efficacy deficiency of the passive noise reduction technique, most products in the market at present adopt the active noise reduction technique to reduce the external background sound in the headphone. For instance, U.S. Pat. No. 8,077,874 entitled "Active noise reduction microphone placing" discloses an active noise reduction microphone that has an error signal gone through a feedback process to combine with an audio in a signal processor, then is fed to a compensator which provides a phase input to an amplifier, then is fed to a sound module to combine with a noise; and through a microphone and an output amplifier, the error signal is formed which is combined with the audio through the feedback process. The above process is repeated cyclically to reduce the noise.

Through the sound module that generates the phase the noise can be offset and reduced, and through the feedback process the noise not being fully eliminated enters a next cycle of the noise reduction process. However, the noise is directly input to combine with the audio without going through any prior process but is reduced through a single loop, the noise reduction effect still leaves a lot to be desired. Moreover, it has merely one sound outlet that makes output sound monotonous and lower in quality. There is still room for improvement.

SUMMARY OF THE INVENTION

The primary object of the present invention is to improve the performance of noise reduction efficacy of the conventional headphone against the ambient noise and also resolve the problem of monotonous output sound that results in lower sound quality in listening music.

To achieve the foregoing object the present invention provides a multi-loudspeaker active noise cancelling headphone that can provide stereo effect and improve the performance of ambient noise reduction. The headphone is connected to and receives an audio signal for broadcasting. It comprises a microphone, a first filter, a first adder, an audio compensator, an active noise cancelling processor, an amplifier, a first loudspeaker, a second filter a second adder, a third filter and a second loudspeaker. The first filter and the second filter are electrically connected to the microphone. The first adder and the second adder are electrically and respectively connected to the first filter and the second filter. The audio compensator and the active noise cancelling processor are electrically connected to the first adder. The amplifier is electrically connected to the active noise cancelling processor. The first loudspeaker is electrically connected to the amplifier. The third filter is electrically connected to the second adder. The second loudspeaker is electrically connected to the third filter The audio signal outputs music to the second adder that is processed and transformed by the third filter to match the characteristics of the second loudspeaker and also take into account of music quality to broadcast a first channel sound through the second loudspeaker.

The microphone receives an ambient noise from a space and outputs an ambient noise signal to the first filter which processes and transforms to a signal to match the characteristics of the first loudspeaker and take into account of music quality requirement, then is sent to the first adder, and joins a music compensation signal processed by the audio compensator, to be sent to the active noise cancelling processor to perform phase process to form a signal required for noise reduction that is sent the amplifier to be amplified and broadcast through the first loudspeaker to become a second channel sound.

The second channel sound is received by the microphone and input to the second filter, and goes through the second adder and enters the third filter for processing, then becomes a third channel sound broadcast via the second loudspeaker. The third channel sound has a signal phase reversed to that of the audio signal and the ambient noise signal, and is an auxiliary noise reduction signal that can improve the performance of noise reduction efficacy.

In short, the second channel sound offsets the ambient noise in the space, then is received by the microphone to output to the second filter for processing, and through the second loudspeaker to broadcast the third channel sound which is reversed in phase against the audio signal and the ambient noise signal, therefore becomes an auxiliary noise reduction signal that can improve the performance of noise reduction efficacy. After the audio signal is input to the headphone, the microphone receives the ambient noise to perform active noise reduction process to generate the third channel sound in a repeatedly cyclical process, thereby can achieve noise cancelling and stereo sound generation efficacy. The first channel sound output from the second loudspeaker and the audio signal are sound of the same phase, hence can improve music quality. The second channel sound output from the first loudspeaker has a phase re versed to that of the audio signal and the ambient noise signal, hence can reduce ambient noise without interfering the music to maintain desired sound quality. The third channel sound also has a phase reversed to that of the audio signal and the ambient noise signal, hence can reduce the noise around 4-10 db. The three channels of sound have time difference (delay) and phase difference among them, and through a repeatedly cyclical process in the space of earmuffs of the headphone, a three dimensional sound effect with a sense of depth can be generated, thus can provide improved music quality than the conventional active noise cancelling headphone.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
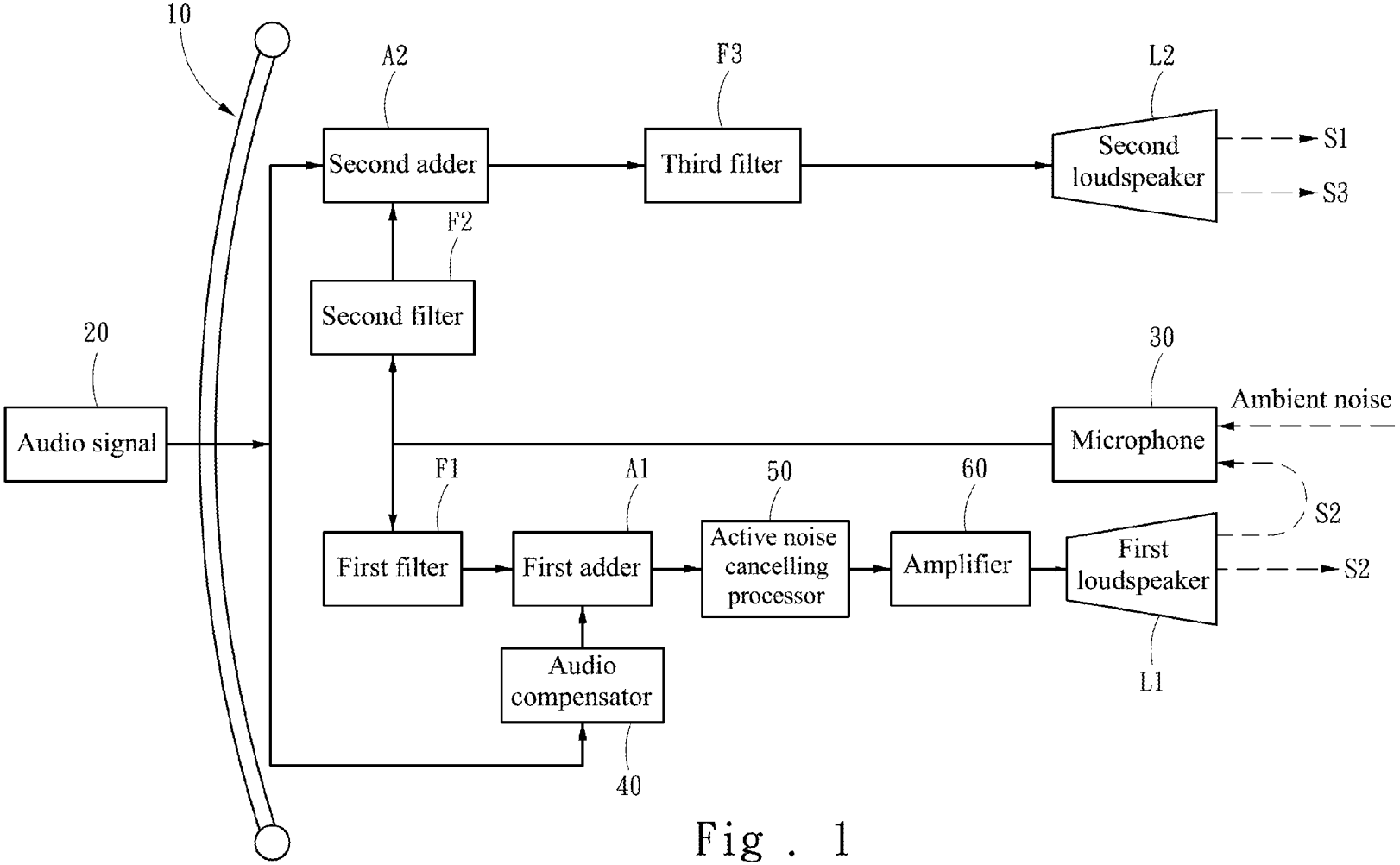
FIG. 1 is a system block diagram of an embodiment of the invention.

Please refer to FIG. 1 for the system block diagram of a first embodiment of the invention. It is for a multi-loudspeaker active noise cancelling headphone that can provide stereo effect and improve the performance of ambient noise reduction. It aims to connect to and output an audio signal 20 to the headphone for broadcasting. The audio signal 20 can be music, for instance. The headphone is collaborated with a pair of earmuffs 10 when in use during broadcasting of the audio signal 20. The headphone comprises a microphone 30, a first filter F1, a second filter F2, a first adder A1, a second adder A2, an audio compensator 40, an active noise cancelling processor 50, an amplifier 60, a first loudspeaker L1, a third filter F3 and a second loudspeaker L2.

The first filter F1 and the second filter F2 are electrically connected to the microphone 30. The first adder A1 and the second adder A2 are electrically connected respectively to the first filter F1 and the second filter F2. The audio compensator 40 and the active noise cancelling processor 50 are electrically connected to the first adder A1. The amplifier 60 is electrically connected to the active noise cancelling processor 50. The first loudspeaker L1 is electrically connected to the amplifier 60. The third filter F3 is electrically connected to the second adder A2. The second loudspeaker L2 and is electrically connected to the third filter F3. The first filter, F1, the second filter F2 and the third filter F3 can be respectively a low pass filter, a high pass filter or a band pass filter.

The audio signal 20 outputs music to the second adder A2 that is processed and transformed by the third filter F3 to match the characteristics of the second loudspeaker L2 and also take into account of music quality to broadcast a first channel sound S 1 through the second loudspeaker L2. The microphone 30 receives an ambient noise from a space and outputs an ambient noise signal to the first filter F1 which processes and transforms to a signal to match the characteristics of the first loudspeaker L1 and take into account of the music quality requirement, then is sent to the first adder A1, and joins a music compensation signal processed by the audio compensator 40, to be sent to the active noise cancelling processor 50 to perform phase process to form a signal required for noise reduction, and sent to the amplifier 60 to be amplified and broadcast through the first loudspeaker L1 to become a second channel sound S2. The second channel sound S2 is received by the microphone 30 and input to the second filter F2, and goes through the second adder A2 and enters the third filter F3 for processing, then becomes a third channel sound S3 broadcast via the second loudspeaker L2. The third channel sound S3 has a signal phase reversed to that of the audio signal 20 and the ambient noise signal, and is an auxiliary noise reduction signal that can improve the performance of noise reduction efficacy.

The sources and function of various sounds in this embodiment are further elaborated as follows:

First, the audio signal 20 is sent to the second adder A2, and passes through the third filter F3, and output through the second loudspeaker L2 to become the first channel sound S1 in a positive phase.

Next, the audio signal 20 is sent to the audio compensator 40 and joins a signal processed via the first filter F1 resulted from the ambient noise received by the microphone 30 that are processed via the first addition advice A1 and the active noise cancelling processor 50 and the amplifier 60 to become the second channel sound S2 in a reversed phase output via the first loudspeaker L1.

Finally, the microphone 30 further receives the second channel sound S2 which passes through the second filter F2 and outputs via the second loudspeaker L2 to become the third channel sound S3 in the reversed phase.

In this embodiment the three channels of sound have phase differences and time differences, and quickly and cyclically and consecutively appear in the earmuffs 10 to form a three dimensional sound effect with a sense of depth, therefore can generate improved sound effect and reduce noise.

Figure 2:
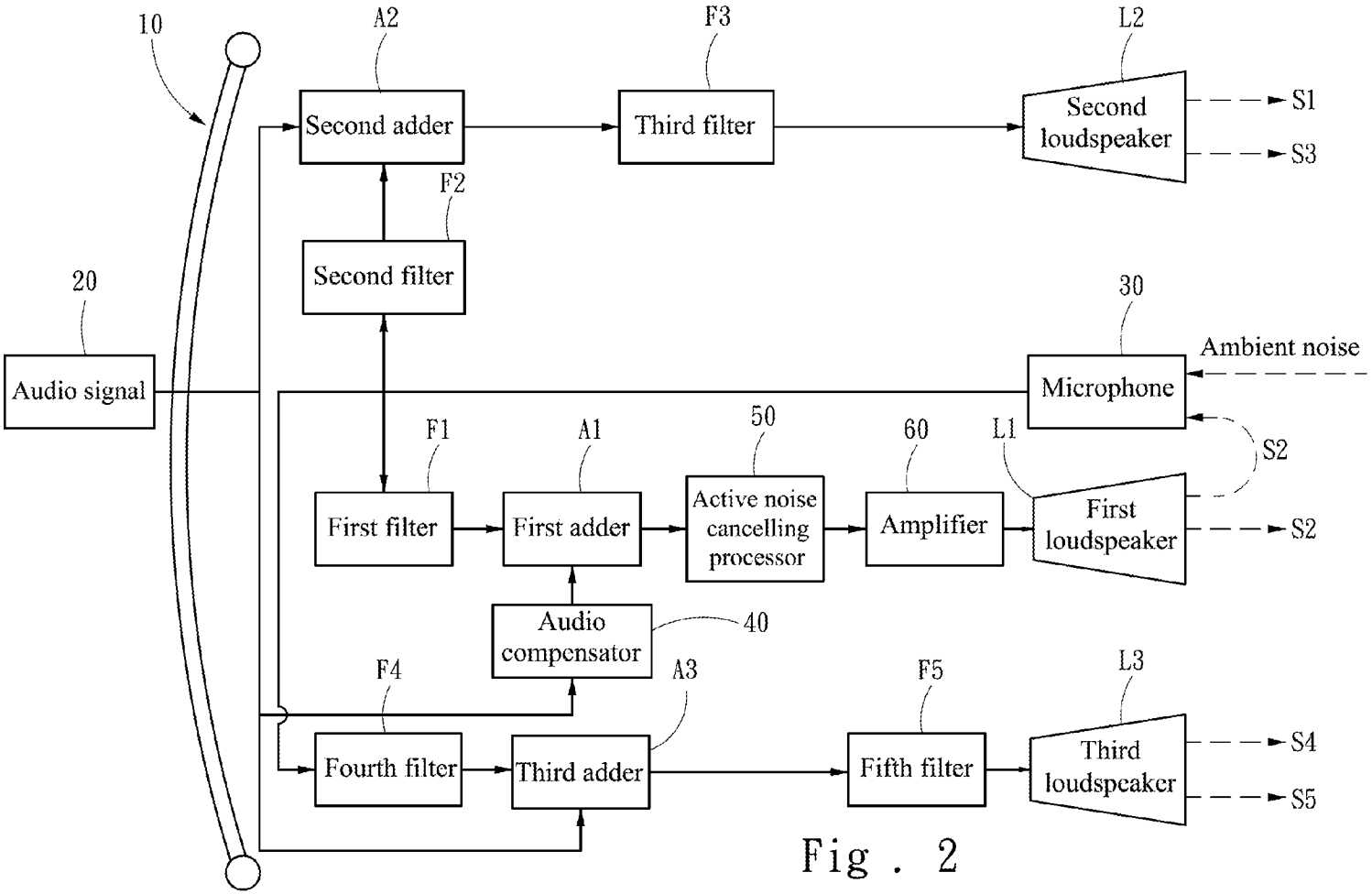
FIG. 2 is a system block diagram of another embodiment of the invention.

Please refer to FIG. 2 for the system block diagram of a second embodiment of the invention. The multi-loudspeaker active noise cancelling headphone in this embodiment further includes a third addition deice A3, a third loudspeaker L3, a fourth filter F4 and a fifth filter F5. The third adder A3 is connected to the audio signal 20. The fourth filter F4 bridges the microphone 30 and the third adder A3. The fifth filter F5 is connected to the third adder A3. The third loudspeaker L3 is connected to the fifth filter F5. The fourth filter F4 and the fifth filter F5 can be respectively a low pass filter, a high pass filter or a band pass filter.

When in use the audio signal 20 outputs music to the third adder A3, and processed and transformed by the fifth filter F5 to match the characteristics of the third loudspeaker L3 and also take into account of music quality requirement to become a fourth channel sound S4 broadcast via the third loudspeaker L3. In addition, the third loudspeaker L3 also can further broadcast a fifth channel sound S5 which also is an auxiliary noise reduction signal with a phase reversed to that of the audio signal 20. Its generation process is same as the third channel sound S3 previously discussed. Aside from the aforesaid embodiments the active noise cancelling headphone can also include more sets of loudspeakers or microphones.

Figure 3:
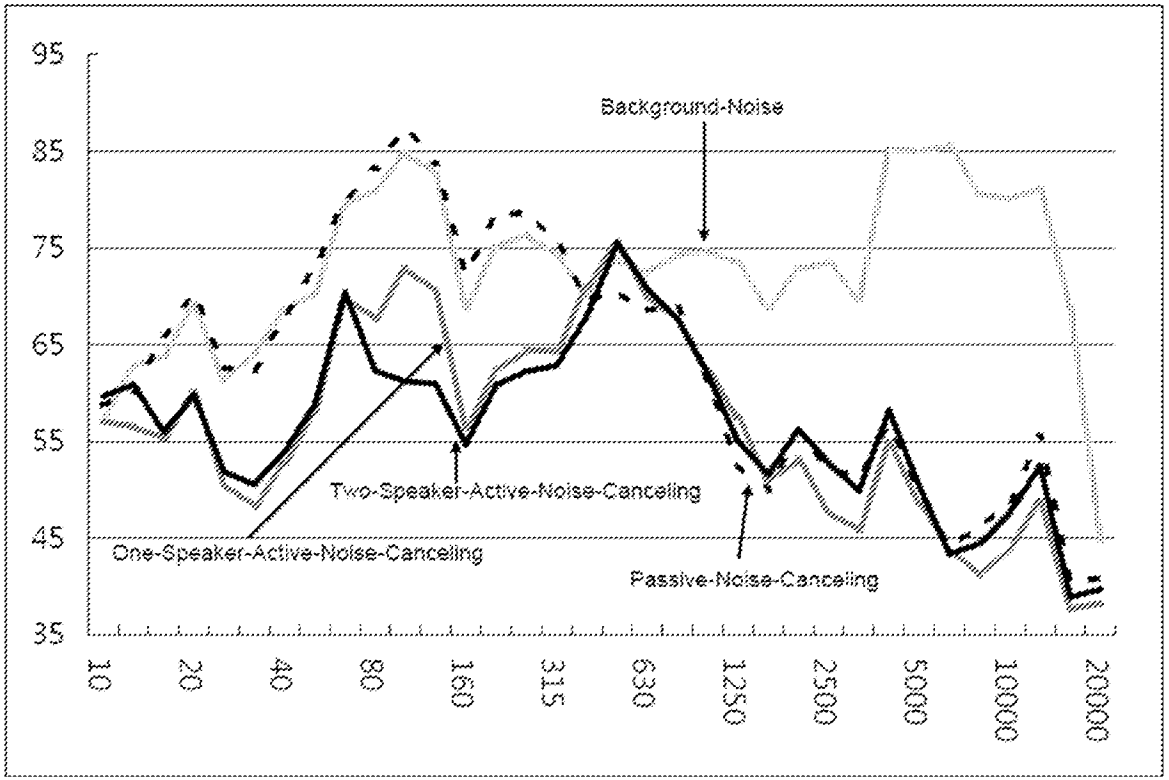
FIG. 3 is a measurement result according one embodiment of the invention.

As a conclusion, according to the invention the second channel sound offsets the ambient noise in the space, the microphone receives the second channel sound and outputs to the second filter for processing then broadcasts the third channel sound through the second loudspeaker, the third channel sound has a phase reversed to that of the audio signal and the ambient noise signal, hence can enhance noise reduction efficacy and also serves as an auxiliary noise reduction signal. From the audio signal being input to the headphone, the microphone receives the ambient noise to actively process noise reduction until generation of the third channel sound, and a repeatedly cyclical process is performed to achieve noise reduction effect. The first channel sound output from the second loudspeaker has the phase same as that of the audio signal, hence can improve music sound quality. The second channel sound output from the first loudspeaker has the phase reversed to that of the audio signal and the ambient noise signal, hence can reduce the ambient noise to avoid the music from being interfered by the ambient noise and maintain desired sound quality. The third channel sound has a phase reversed to that of the audio signal, hence can reduce the noise around 4-10 db, please refer to FIG. 3. Those three channel sounds have time differences (delay) and phase differences among them, and repeatedly circulate in the space of the earmuffs to form a three dimensional sound effect with a sense of depth, thus can provide better quality of music than the noise reduction effect of the conventional active noise cancelling headphone, and provide significant improvements over the conventional techniques.

While the preferred embodiments of the invention have been set forth for the purpose of disclosure, they are not the limitation of the invention, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A multi-loudspeaker active noise cancelling headphone providing stereo effect and improved the performance of ambient noise reduction, connected to an audio signal for receiving and broadcasting thereof, comprising:

a microphone;

a first filter and a second filter that are electrically connected to the microphone;

a first adder and a second adder that are electrically and respectively connected to the first filter and the second filter;

an audio compensator to receive the audio signal and an active noise cancelling processor that are electrically connected to the first adder;

an amplifier electrically connected to the active noise cancelling processor;

a first loudspeaker electrically connected to the amplifier;

a third filter electrically connected to the second adder; and a second loudspeaker electrically connected to the third filter;

wherein the audio signal outputs music to the second adder that is processed and transformed by the third filter to match characteristics of the second loudspeaker and take into account of music quality to broadcast a first channel sound through the second loudspeaker;

wherein the microphone receives an ambient noise from a space and outputs an ambient noise signal to the first filter to be processed and transformed to match characteristics of the first loudspeaker and take into account of noise reduction and broadcast music quality requirements and joins a music compensation signal from the audio compensator to be output to the active noise cancelling processor for phase processing to form a required noise reduction signal output to the amplifier which amplifies the signal to become a second channel sound broadcast through the first loudspeaker;

wherein the second channel sound is received by the microphone and output to the second filter, and input to the third filter through the second adder to be processed and broadcast by the second loudspeaker to become a third channel sound which has a phase reversed to that of the audio signal and the ambient noise signal to improve the performance of noise reduction efficacy and become an auxiliary noise reduction signal.

2. The multi-loudspeaker active noise cancelling headphone of claim 1, wherein the first filter, the second filter and the third filter are selected from the group consisting of a low pass filter, a high pass filter and a band pass filter.

3. The multi-loudspeaker active noise cancelling headphone of claim 1 further including a third adder connected to the microphone and the audio signal and a third loudspeaker connected to the third adder.

4. The multi-loudspeaker active noise cancelling headphone of claim 3 further including a fourth filter to bridge the microphone and the third adder and a fifth filter to bridge the third adder and the third loudspeaker.

5. The multi-loudspeaker active noise cancelling headphone of claim 4, wherein the fourth filter and the fifth filter are selected from the group consisting of a low pass filter, a high pass filter and a band pass filter.

* * * * *